US005944622A

United States Patent [19]

Buck et al.

[11] Patent Number: 5,944,622

[45] Date of Patent: Aug. 31, 1999

[54] STRUNG RACQUET TRAINING WEIGHT SYSTEM

[75] Inventors: James K. Buck, 2636 Laurel Dr., Vero Beach, Fla. 32960; Scott C. Raymond, Kalkaska; Michael C. Anger, Mancelona, both of Mich.

[73] Assignee: James K. Buck, Vero Beach, Fla.

[21] Appl. No.: 09/200,544

[22] Filed: Nov. 25, 1998

Related U.S. Application Data

[60] Provisional application No. 60/073,187, Jan. 30, 1998.

[51] Int. Cl.[6] ..... A63B 69/38

[52] U.S. Cl. ..... 473/437; 473/519; 473/553; 473/459

[58] Field of Search ..... 473/519, 553, 473/554, 422, 459, 461, 463, 437

[56] References Cited

U.S. PATENT DOCUMENTS

| | | | |
|---|---|---|---|
| D. 331,436 | 12/1992 | Yanahara | D21/729 |
| D. 343,663 | 1/1994 | Hillock | D21/756 |
| D. 368,749 | 4/1996 | Severa et al. | D21/753 |
| 2,932,514 | 4/1960 | Bergmark . | |
| 3,330,560 | 7/1967 | Higdon . | |
| 3,414,260 | 12/1968 | Gust . | |
| 3,913,911 | 10/1975 | Peterson . | |
| 4,005,864 | 2/1977 | Stewart . | |
| 4,052,062 | 10/1977 | Casavant | 473/554 |
| 4,063,730 | 12/1977 | Bates | 473/463 |
| 4,076,239 | 2/1978 | Hall | 473/463 |
| 4,108,433 | 8/1978 | Althoff . | |
| 4,200,285 | 4/1980 | Petitti, Jr. . | |
| 4,249,728 | 2/1981 | Bratt . | |
| 4,489,942 | 12/1984 | Kent | 473/553 |
| 4,671,510 | 6/1987 | Schoenwetter . | |
| 4,697,811 | 10/1987 | Muroi . | |
| 5,039,097 | 8/1991 | Bartlett . | |
| 5,083,777 | 1/1992 | Held . | |
| 5,106,086 | 4/1992 | Acosta | 473/522 |
| 5,409,217 | 4/1995 | Bobby . | |
| 5,792,011 | 8/1998 | Kuebler | 473/520 |

*Primary Examiner*—Raleigh W. Chiu

*Attorney, Agent, or Firm*—Reising, Ethington, Barnes, Kisselle, Learman & McCulloch, P.C.

[57] ABSTRACT

A training weight aid for a sports racquet having longitudinal strings and lateral strings strung to span its head frame and creating interstices framed by said strings has a pair of opposed shells interengaged with the strings on opposite sides thereof to provide a shell assembly within the head of the racquet. Longitudinal and lateral rows of spaced apart, shell nub projections, dimensioned and spaced to be received by the strings, extend axially into the space interstices such that many are in lateral gripping engagement with the strings. A pair of disengageable fasteners extend axially through the string space interstices to axially lock the shells together in opposing relation on the strings.

20 Claims, 3 Drawing Sheets

STRUNG RACQUET TRAINING WEIGHT SYSTEM

The present invention is concerned with racquet string supported training weights for use by tennis players, for example, in warm-up exercising prior to playing, and in general conditioning and stroke perfection exercising. The present application claims the priority of provisional application 60/073,187 filed Jan. 30, 1998.

BACKGROUND OF THE INVENTION

Various weighting devices have been previously proposed for accomplishing the functions to be performed. Most, to our knowledge, have involved racquet frame supported weighting devices and some have been of a permanently secured nature, or nature which rendered ready removal and resecural difficult. Devices which have been suggested for application to the racquet strings have not, to our knowledge, interacted with the strings in the manner contemplated by the present invention to secure the assembled weighting system in position.

SUMMARY OF THE INVENTION

One of the prime objects of the present improved string supported weighting system is to provide a multi-purpose device useful in a sport specific manner to stretch the arm muscles and warm-up the shoulder and torso muscles which are used in games such as tennis.

Another object of the invention is to provide a weighting device of the character described which, with use over time, strengthens the muscles used in racquet sports, such as tennis, and improves their conditioning and flexibility. Used on a regular basis, the device enhances the neuro-muscular training that is necessary for the development of technically sound tennis strokes.

Still another object of the invention is to provide a readily removable and reattachable string supported weighting system which enhances stroke perfection and control in that swinging, preferably, the users own racquet with the device attached assists bringing the head of the racquet through the stroke and better trains the follow-through motion.

A further object of the invention is to provide a weighting assembly which grips the strings in a manner to prevent any deleterious lateral shifting or rotation of the secured mating halves of the assembly, and interacts with the strings without damaging them.

A still further object of the invention is to make available a relatively economical, effective muscle training weight device which is also durable and reliable.

Another object of the invention is to provide a new method of fabricating weighting devices of the character to be described and a new method of securing the parts in position on the strings.

In the environment of a strung racquet having a handle merged with an enlarged frame head with crisscrossed strings strung in the head frame under tension and providing interstitial openings between the crisscrossed strings, the improvement invention contemplates an improved weighting device to be carried safely by the strings comprising:

a. a pair of mating shell-like halves having confronting perimetral flanges or surfaces;

b. a string related pattern of discrete flexible nub-like projections extending axially from the shell flanges into the racquet's interstitial string spaces, a plurality of the projections laterally engaging the strings to laterally stabilize the assembled position of the shell halves; and c. a fastener system having parts or surfaces engagable to fasten the halves axially together.

More specifically the fastener system which locks the shell halves together comprises revolvable lock posts which extend in diametral orientation through the mating flanges of the assembled shell halves and which can be manually revolved from a fastened rotary position to a nonfastened rotary position. The posts are laterally spaced apart a distance which permits them to pass through spaced apart string interstices and positions the nub-like projections generally to do the same.

THE DRAWINGS

The presently preferred embodiment of the invention is disclosed in the following description and in the accompanying drawings, wherein.

DETAILED DESCRIPTION

Figure 1:
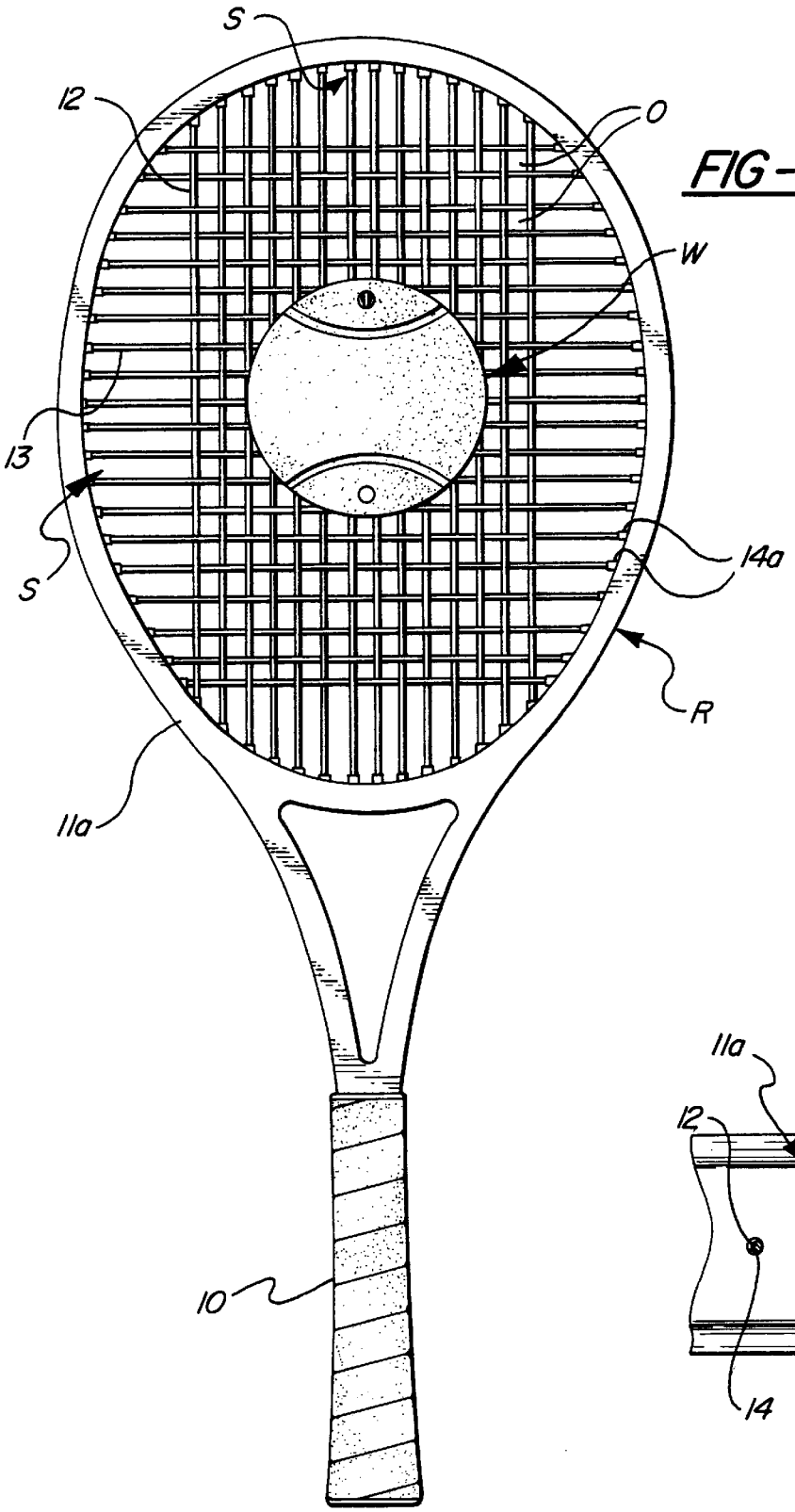
FIG. 1 is a plan view diagrammatically showing the weighting device assembled on a typical tennis racquet.
Figure 2:
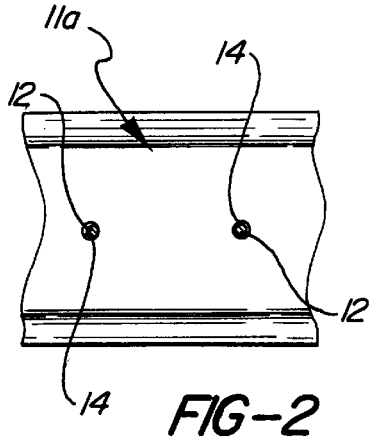
FIG. 2 is an enlarged fragmentary exterior elevational view of a portion of the racquet frame.

Referring now more particularly to the accompanying drawings, the racquet depicted, generally indicated at R, includes a handle 10 merged with a head, generally indicated at 11, which includes a substantially rigid frame portion 11*a* having crisscrossed interlaced strings S. The strings S include vertical string portions 12 and horizontal string portions 13 which extend relatively generally at right angles through the frame string openings or the like, which are shown at 14 in FIG. 2, and predetermine the string spacing. Ferrules 14*a* may be provided to protect the strings S.

Immobily clamped on the strings S in a position which normally would be horizontally central but may vary from the vertically central position in which it is shown, is my improved weighting assembly or system, generally designated W. The weighting assembly weight, training aid, or weight device, generally designated W, comprises a pair of identical annular shells, or shell-like halves 15 and 15*a* having mating annular perimetral flange portions or surfaces 16 and central dome portions 17 with strengthening ribs 17*a* extending from rib cores 17*b*. The halves 15 and 15*a* may be molded of a synthetic thermoplastic rubber material or elastomer which is somewhat resilient such as the material known as Starflex P-7360 manufactured by Star Thermoplastic Alloy and Rubbers, Inc. of Glenview, Ill., which has a durometer rating of sixty.

Figure 3:
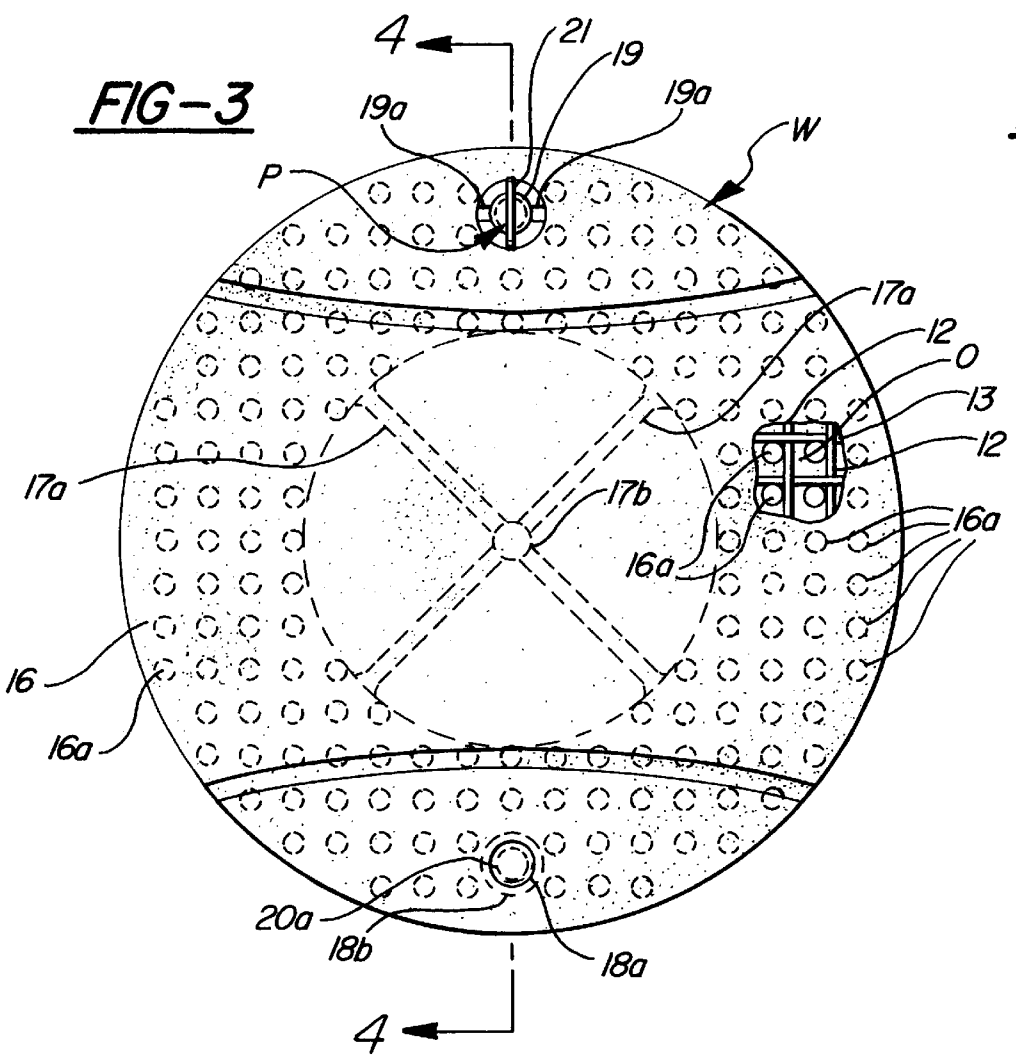
FIG. 3 is a top plan view of the assembled device, partly broken away to illustrate the interaction with the racquet strings.
Figure 5:
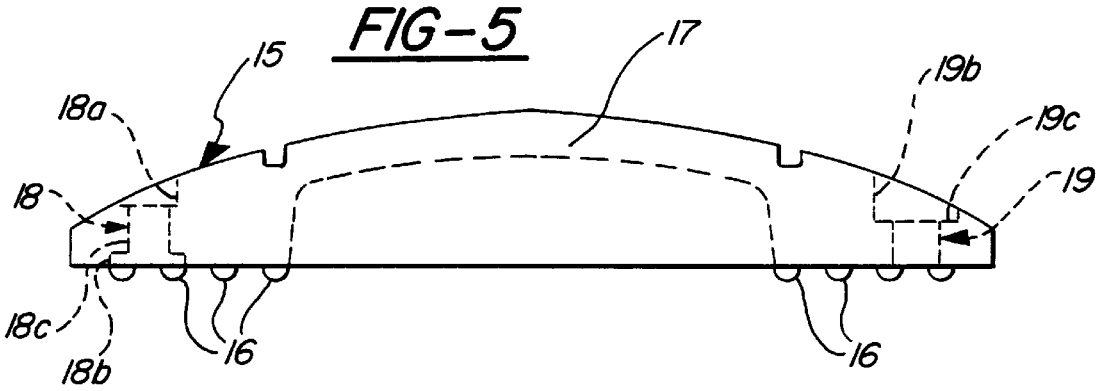
FIG. 5 is a side elevational view of a non-ribbed version of one of the shell halves.
Figure 6:
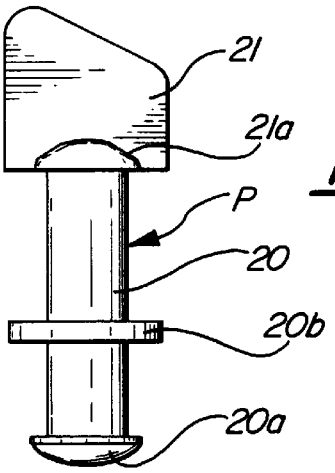
FIG. 6 is a side elevational view of one of the identical assembly lock posts.
Figure 7:
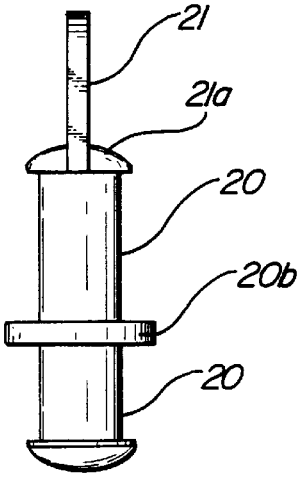
FIG. 7 is an end elevational view thereof.
Figure 8:
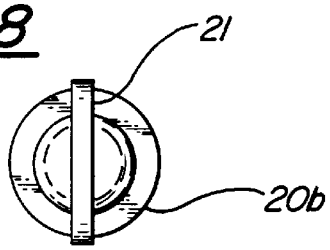
FIG. 8 is a top plan view thereof.

Extending generally perpendicularly from the flanges surfaces or portions 16 of shells 15 and 15*a* are axially mating nub projections 16*a* of a rubbery, somewhat deformable and flexible nature which are provided in a racquet string pattern as shown to extend axially into the string interstices or openings defined by the vertical and horizontal strings 12 and 13. In assembled position, a number of the nubs 16*a*, which have rounded free ends as shown, lie adjacent to at least a number of the strings 12 and 13 (see FIG. 3) and bear laterally against them when any force is applied which would tend to shift the assembled device W on the strings. With the nubs 16*a* having some deformability, and, in fact, the whole device being molded out of the same deformable material, the strings 12 and 13 which, of course, may be formed of a suitable plastic or gut material are resiliently gripped by the assembly device W.

Typically the horizontal strings 12 and the vertical strings 13 are located about ⅜ of an inch apart, but, of course, this spacing varies to some extent from racquet to racquet.

Figure 4:
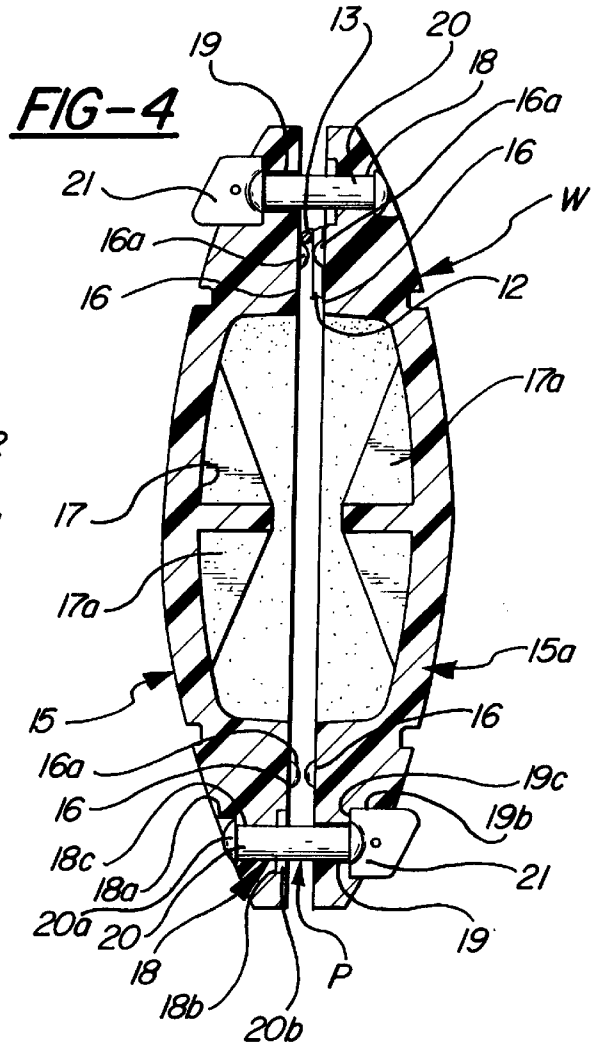
FIG. 4 is a sectional view through the racquet strings and assembled device taken on the line 4—4 of FIG. 3, the strings and weighting device nubs being only partly illustrated in the interests of clarity.

Provided diametrally (see FIGS. 3 and 4) in the shell halves 15 and 15*a* are openings or passages 18 on one side of each of the halves 15 and 15*a* and openings or passages 19 on the other. The openings 18 have an enlarged partial counterbore 18*a* and an enlarged portion 18*b* connected by a reduced diameter portion 18*c*. They are provided for receiving and retaining a revolvable lock post, generally designated P. Post P includes stem portion 20, an end cap 20*a* of greater diameter than the opening 18 so as to be retained within counterbore 18*a*, and a flange 20*b* which is received within opening portion 18*b*. On the opposite end of each post P is an integral enlarged lock blade 21 with its shoulder 21*a*. It is to be noted that the otherwise annular openings 19 have slitted portions 19*a* of a size to slideably axially pass the blades 21 and shoulders 21*a*, when the blades 21 are in alignment with them.

An enlarged portion or counterbore 19*b* provided at the outer end of each passage 19, provides a lock shoulder 19*c* and permits rotation of each post P from a position in which the blade 21 aligns with the slits 19*a* to a position in which it does not and engages the shoulder 19*c* to lock the mating halves 15 and 15*a* in assembled position. The openings 18 and 19, in their respective shell halves 15 and 15*a*, are located a predetermined diametral distance apart, which considers the spacing of the strings and the positions of the nub projections 16*a*. By having openings 18 and 19 in each of the halves 15 and 15*a*, the halves 15 and 15*a* can be, and typically are, fabricated in the same mold. Typically the post P is molded of a harder more rigid material, such as nylon.

The Operation

To assemble the weighting assembly W on the strings S is a relatively simple operation. It is only necessary to dispose the mating halves 15 and 15*a* on opposite sides of the racquet face in the desired position with the respective post blades 21 in a position of alignment with the slits or slots 19*a* which are to receive and pass them. The posts P are so diametrally positioned that they will extend through the interstices or openings 0 provided between the strings 12 and 13 and act, in this regard, to align the shell halves 15 and 15*a* so that the nub-like projections 16*a* substantially axially align also. Once the blades 21 are extended through the slits 19*a*, they may be grasped and rotated sufficiently through a part of a turn such that their inner edges overlie the locking shoulder surface 19*c*. When this occurs, the projections 16*a*, or many of them, will be in the positions shown in the broken away portion in FIG. 3.

The removal of the halves 15 and 15*a* from the racquet may be as readily accomplished in reverse order by simply turning the posts P until the blades 21 line up with the slitted openings 19*a* and then pulling the halves 15 and 15*a* apart.

When in assembled position, the weighting device will typically weigh slightly less than half a pound. In assembled position, a plurality of the nubs 16*a* laterally grip the strings with which they are in contact, and prevent lateral displacement of the device on the strings S. Because the halves 15 and 15*a* can be so readily disassembled, the weighting device W can be used on the player's own racquet which, of course, is the racquet with which the player and his or her muscles are familiar.

Method of Making

In practice, the mold halves 15 and 15*a* are molded in the same or identical molds, without the posts P in position. The posts P are molded of a different more rigid material and, just after the thermoplastic halves 15 and 15*a* are removed from the mold and are still warm and most deformable, the posts P can be readily pressed axially into the openings 18. The heads 20 of the post are of such diameter that they can be pressed up through the openings 18, which deform laterally sufficiently to permit them to pass. The final position of the posts P is predetermined by the entry of the annular flanges 20*b* into the openings 18*b*.

Typical thermoplastics which we contemplate may be molded to form shells 15 and 15*a* are the conventional elastomers, such as styrene-butadiene block copolymers and the urethane elastomers, which are well known and commercially available. Other plastics or materials may also be used for the locking posts.

The disclosed embodiment is representative of a presently preferred form of the invention, but is intended to be illustrative rather than definitive thereof. The invention is defined in the claims.

We claim:

1. In combination with a sports racquet having a handle and a head frame with longitudinal strings and lateral strings strung to span said head frame in criss cross formation and defining space interstices framed by said longitudinal and lateral strings; a training weight aid comprising:

a. a pair of opposed shells disposed on said strings on opposite sides thereof to provide a shell assembly within the head frame of the racquet;

b. said shells having surfaces in confronting relation;

c. longitudinal and lateral rows of spaced apart, shell nub projections, dimensioned and spaced to be received by the strings, extending axially into said space interstices, many of said nub projections being in lateral gripping engagement with said strings; and d. at least one fastener lock device engaging one shell extending axially through a string space interstice and having a part engaging the other shell to axially lock the shells together in opposing relation on said strings.

2. The combination of claim 1 wherein the opposed shells have nub projections in abutting alignment and said other shell has a passage receiving said lock device to secure the alignment of said nubs.

3. The combination of claim 1 wherein said shells are matching shells, molded of an elastomeric synthetic plastic material to provide somewhat resilient nubs of generally circular cross-section which are identically laterally and longitudinally spaced.

4. The combination of claim 1 wherein said shells are circular and dome-shaped with annular perimetral flanges constituting said confronting surfaces, and said nub projections are somewhat resilient and have rounded free ends.

5. The combination of claim 1 in which a pair of said lock devices are provided diametrally in a spaced apart relation correlating with said string interstices to extend therethrough.

6. The combination of claim 4 in which said lock devices are rotatable posts, one provided on each shell, said posts having enlarged locking blades at one end thereof; and post and blade openings are provided through said shells to permit passage of a post and blade through an opposite shell in one non-locking position, said shells having locking shoulders restraining axial movement of said blades and shells upon rotation of said posts to a second locking position.

7. The combination of claim 6 wherein each of said shells is formed with a mounting passage for lockably retaining a projecting post with said blade on the projecting end thereof, and a second passage for receiving the projecting end and blade of a post on the other shell constituting said post and blade opening.

8. The combination of claim 7 wherein said mounting passage has an outer mouth and an enlarged flange receiving opening spaced axially inwardly from the mouth of said passage and said post has a flange received therein to anchor said post in position.

9. For use with a sports racquet having a handle and a head frame with longitudinal strings and lateral strings strung to span said longitudinal strings to define a strung racquet formation incorporating space interstices framed by said longitudinal and lateral strings; a training weight aid comprising:

a. a pair of opposed shells adapted to be disposed on said strings on opposite sides thereof to provide a shell assembly mountable within the head frame of the racquet;

b. said shell having perimetral surfaces in confronting relation;

c. longitudinal and lateral rows of spaced apart, transversely extending shell nub projections in a formation corresponding to the string interstices, dimensioned and spaced to be received within such string interstices; and d. at least one releasable fastener on one shell, for extending axially through a string space interstice, having a part disengageably locking with the other shell to lock the shells together when the shells are in opposing relation on said strings.

10. The combination of claim 9 wherein the opposed shells are circular and have nub projections in axially abutting alignment, the shells being provided as molded of an elastomeric synthetic plastic material to provide somewhat resilient nubs of generally circular cross-section with rounded free ends.

11. The combination of claim 9 in which a pair of said fasteners are provided diametrally in a spaced apart relation with respect to said string interstices so as to be extendible therethrough.

12. The combination of claim 11 in which said fasteners are posts, one provided on each shell, said posts having enlarged locking blades at one end thereof; and post and blade openings are provided through each shell opposite as post on the opposite shell to permit passage of a post and blade through said opposite shell in one position, said shells having locking shoulders restraining axial movement of said shells upon rotation of said blades to a second position.

13. The combination of claim 12 wherein each of said shells is formed with a mounting passage for lockably retaining a projecting post with said blade on the projecting end thereof, and a second passage for receiving the projecting end and blade of a post on the opposite shell constituting said post and blade opening.

14. The combination of claim 13 wherein said mounting passage has an outer mouth and an enlarged flange receiving opening spaced axially inwardly from the mouth of said passage, and said post has a flange received therein to anchor said post in position.

15. In a method of making a training weight aid for a sports racquet having a handle and a head frame with longitudinal strings and lateral strings defining a formation of space interstices framed by said longitudinal and lateral strings; the steps of:

a. providing a pair of opposed shells adapted to be disposed on said strings on opposite sides thereof to provide a shell assembly within the head frame of the racquet;

b. providing the perimetral surfaces of at least one shell with confronting longitudinal and lateral rows of spaced apart nub projections in such formation, dimensioned and spaced to extend axially into said space interstices and engage said strings laterally; and c. providing at least one axially projecting fastener device to extend axially through a string space interstice, and having parts engageable with the shells for locking the shells together as an assembly in opposing relation on said strings.

16. The combination of claim 15 comprising providing opposed shell nub projections in abutting alignment.

17. The combination of claim 16 comprising molding said shells and nubs of an elastomeric synthetic plastic material to provide resilient generally hemispheric nubs on each shell which are identically laterally and longitudinally spaced.

18. The combination of claim 17 comprising providing a pair of said fastener devices as posts, one provided on each shell, with said posts having enlarged locking blades at one end thereof; providing post and blade receiving openings through said shells to permit passage of a post and blade through an opposite shell in one position; inserting said posts and blades through said openings; and providing said shells with locking shoulders restraining axial movement of said blades upon rotation of said blades to a second locking position.

19. The method of claim 18 comprising providing each of said shells with a mounting passage for lockably retaining a projecting post with said blade on the projecting end thereof, and a second passage for receiving the projecting end and blade of a post on the other shell constituting said post and blade opening; providing each of said mounting passages with an outer mouth and an enlarged flange receiving opening spaced axially inwardly from the mouth of each passage; and providing each of said posts with a flange received in each said flange receiving opening to anchor said posts in position.

20. The method of claim 19 wherein said shells, while still warm from said molding step, have the posts inserted in said mounting passages to permit said flanges to deform said mounting passages and pass through to be received in said enlarged flange receiving openings.

* * * * *